US006656585B2

(12) United States Patent
Takatsuji

(10) Patent No.: US 6,656,585 B2
(45) Date of Patent: Dec. 2, 2003

(54) THREAD

(76) Inventor: Hiroshi Takatsuji, 3-13-3 Nakaochiai, Shinjyuku-ku, Tokyo (JP)

( * ) Notice: Subject to any disclaimer, the term of this patent is extended or adjusted under 35 U.S.C. 154(b) by 0 days.

(21) Appl. No.: 10/022,978

(22) Filed: Dec. 13, 2001

(65) Prior Publication Data

US 2002/0168519 A1 Nov. 14, 2002

Related U.S. Application Data

(63) Continuation-in-part of application No. 09/784,573, filed on Feb. 15, 2001, now abandoned.

(51) Int. Cl.[7] ..... D01F 6/00
(52) U.S. Cl. ..... 428/397; 428/374; 428/372
(58) Field of Search ..... 428/397, 372, 428/374; 44/44.98

(56) References Cited

U.S. PATENT DOCUMENTS 2,164,296 A * 6/1939 Wilcox et al. ..... 43/44.98
2,274,255 A * 2/1942 Pierce ..... 43/44.98
2,748,525 A * 6/1956 Volz ..... 43/44.98
3,043,045 A * 7/1962 Martuch ..... 43/44.98
3,830,009 A * 8/1974 Collingbourne ..... 43/44.98
4,048,744 A * 9/1977 Chandler ..... 43/44.98
4,501,564 A * 2/1985 Cairone, Sr. ..... 441/20
5,176,725 A * 1/1993 Puri et al. ..... 55/158
5,866,253 A * 2/1999 Philipps et al. ..... 428/374

FOREIGN PATENT DOCUMENTS

JP 410014460 * 1/1998

* cited by examiner

*Primary Examiner*—N. Edwards
(74) *Attorney, Agent, or Firm*—Jordan and Hamburg LLP

(57) ABSTRACT

A thread has a thread body formed of a continuous and monolithic synthetic resin material. The thread body defines chambers serially disposed along a length of the thread body and separated from one another by partitions. A gas, which may be lighter than air, fills the chambers. An embodiment has the chambers as radially adjacent chambers dispose along two to four radially adjacent longitudinal sectors of the thread body. The partitions of the two to four sectors are disposed either at common longitudinal locations or offset locations. The thread may be used as a fishing line that floats or in survival equipment wherein buoyancy is enhance. Still further, the thread provides for enhanced thermal insulation when used to weave a cloth.

15 Claims, 16 Drawing Sheets

THREAD

RELATED APPLICATIONS

This is a continuation-in-part of application Ser. No. 09/784,573, filed Feb. 15, 2001 now abandoned.

BACKGROUND OF THE INVENTION

The present invention relates generally to a thread that is used for survival equipment, such as a life jacket, a swimming suit, and a lifesaving flag, and relates to the thread that can be used for a fishing line etc.

Conventional survival floatation equipment, such as a life jacket, has a buoyant object enclosed or attached to a cloth covering. When the buoyant object is a foam material, the floatation equipment becomes bulky and is inconvenient to carry. Furthermore, when the buoyant object is an inflated object, such as an air bag, the inflated object must be blown up at the time of use if one does not wish to carry the inflated object in a bulky, inflated state.

SUMMARY OF THE INVENTION

Accordingly, it is an object of the present invention to provide a thread which provides for buoyancy in objects formed thereof without increasing the bulk of the objects.

It is another object of the present invention to provide a thread that includes air and does not require inflation at a time of use. Such thread may be used for survival equipment to increase buoyancy.

It is still another object of the present invention to provide a thread which can be used as a fishing line which can be smoothly cast and reeled in and which can float on the water surface in either fresh or salt water environments.

It is further object of the present invention to provide a thread that is lightweight and of sufficient strength and pliability to be used as a fishing line, and which limits damage when cracked to only a localized area while retaining buoyancy overall.

The present invention is understood to encompass embodiments which include all or only a portion of the above objects, features and advantages which, unless recited in claims defining the invention, are understood not to limit interpretation of such claims. The above, and other objects, features and advantages of the present invention will become apparent from the following description read in conjunction with the accompanying drawings, in which like reference numerals designate the same elements.

It is to be expressly understood, however, that the drawings are for the purpose of illustration and description only, and are not intended as a definition of the limits of the invention.

DETAILED DESCRIPTION

Figure 1:
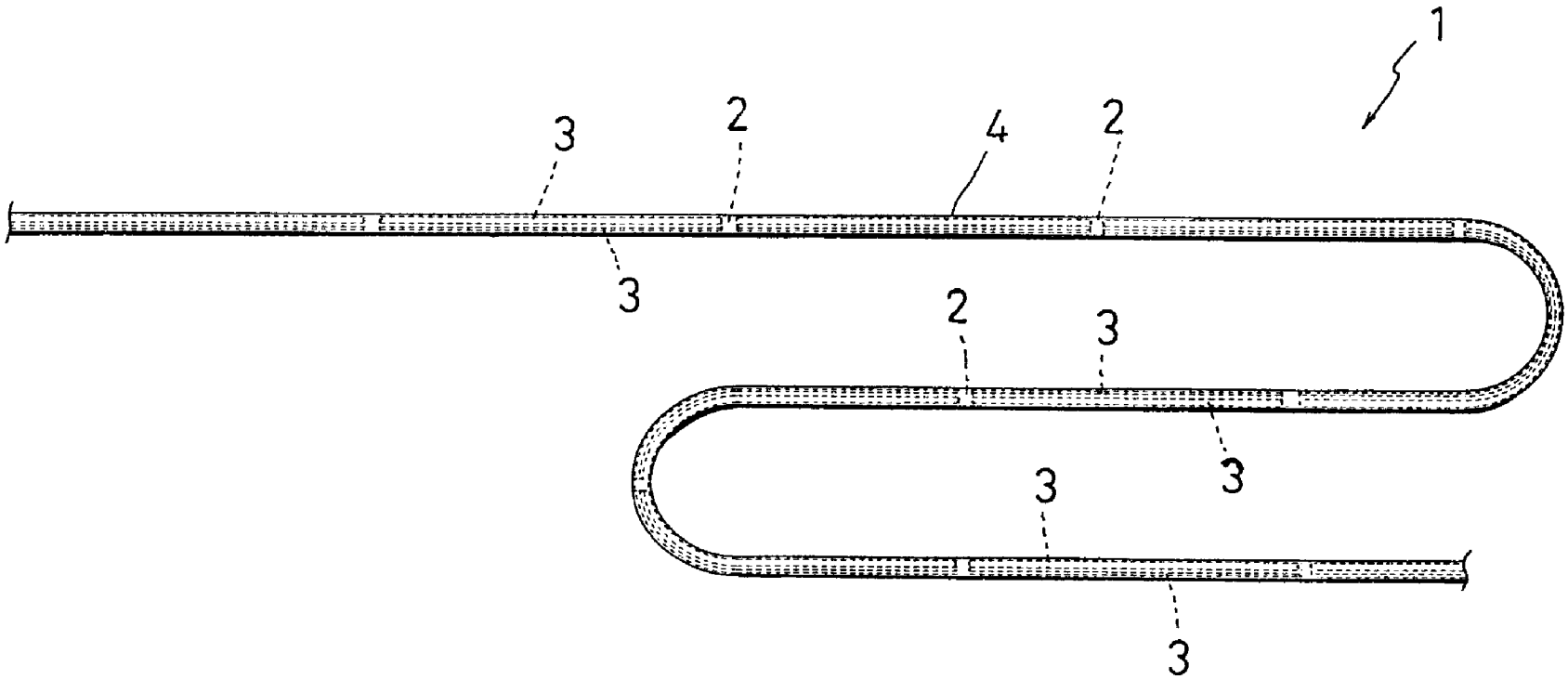
FIG. 1 is a side view showing a first embodiment of the present invention.
Figure 2:
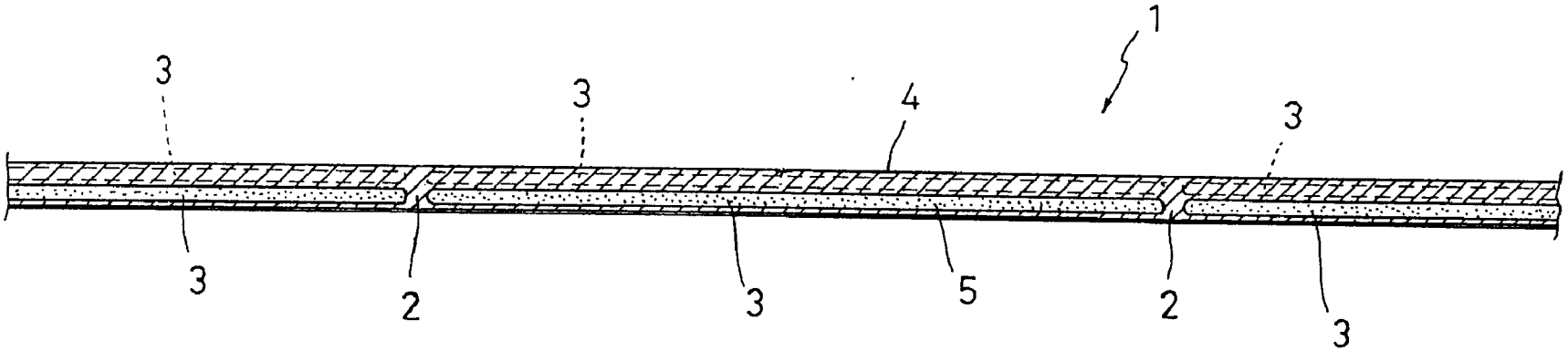
FIG. 2 is an enlarged vertical sectional view showing the first embodiment of the present invention.
Figure 3:
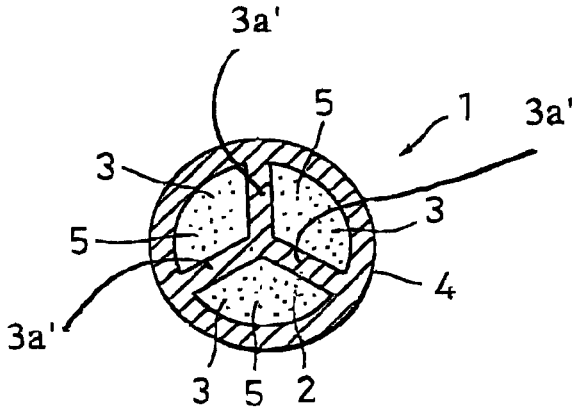
FIG. 3 is an enlarged horizontal sectional view showing the first embodiment of the present invention.

Preferred embodiments of the present invention are described in more detail below referring to the accompanying drawings.

An understanding of the present invention may be best gained by reference FIGS. 1 to 9. FIGS. 1 to 9 illustrate an embodiment of a thread of the present invention.

The thread 1 comprises a thread body 4 fabricated using a synthetic resin material such as nylon, fluorocarbon, polyarnide and polyester, and which material is used to enclose a gas 5. The thread body 4 has an almost uniform outside size, and at least two or more radially adjacent chambers 3 at a given radial cross section in this embodiment, in particular, three radially adjacent chambers 3, 3, and 3 are shown which are blockaded by partitions 2 and separated by longitudinal side walls 3*a*. The radially adjacent chambers 3 are disposed along radially adjacent longitudinal sectors of the thread 1 extending over a length of the thread 1. The partitions 2 are optionally formed at intervals having 10 to 20 times a length of a diameter of the thread. However, other ratios may be used. The gas 5 may be hydrogen gas with a specific gravity lighter than air. Alternatively, other light gases, such as helium gas, may be used. Still further, air itself may be used.

Figure 4:
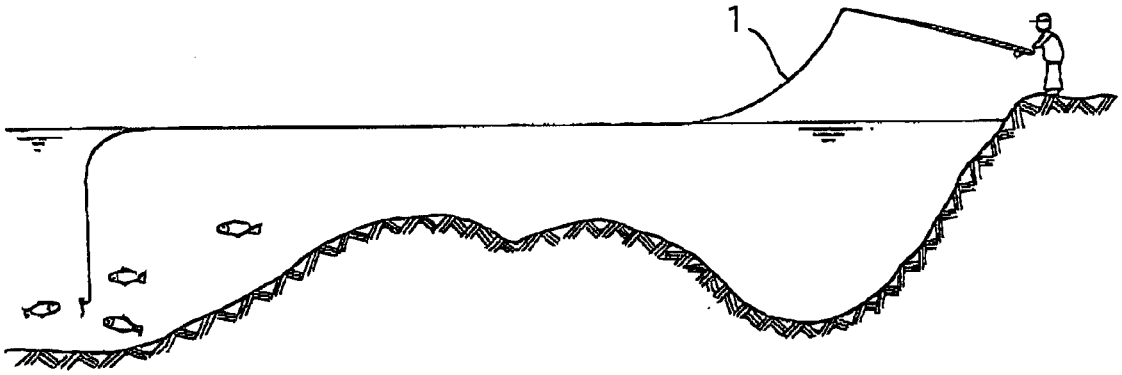
FIG. 4 is a view showing the first embodiment of the present invention in use as a fishing line.

The outer diameter size of the thread is preferably formed almost uniformly. Such uniform formation allows the thread 1 to be used as a fishing line because the thread 1 can be smoothly cast and reeled. Moreover, the fishing line formed of the thread 1 will float on a sea surface or the water surface, as shown in FIG. 4.

The partitions 2 formed at the predetermined intervals provide for resistance to damage. If a crack forms in a part of the thread body 4 and opens into one of the chambers 3, influx of water into the cracked chamber 3 will be limited to that chamber 3 by the partitions 2 defining the chamber 3.

Thus, the remaining chambers 3 do not fill with water and the effect of the crack on the thread 1, when used as a fishing line or in other aquatic applications, is limited.

Figure 5:
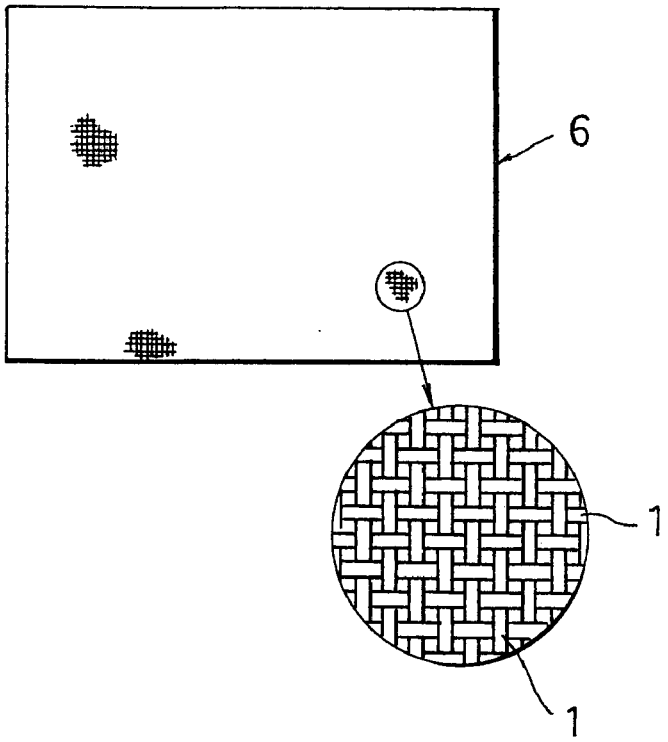
FIG. 5 is a view illustrating the first embodiment of the present invention used in a cloth used for survival equipment.
Figure 6:
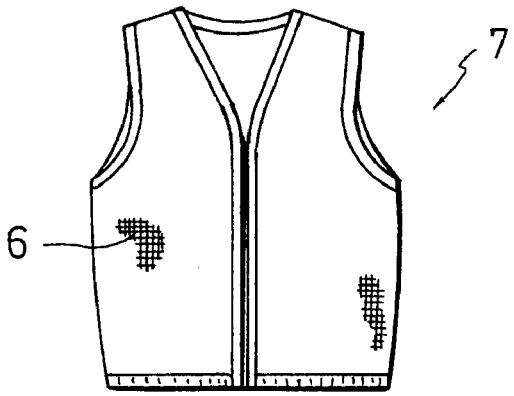
FIG. 6 is a view illustrating the first embodiment of the present invention used in a life jacket.
Figure 7:
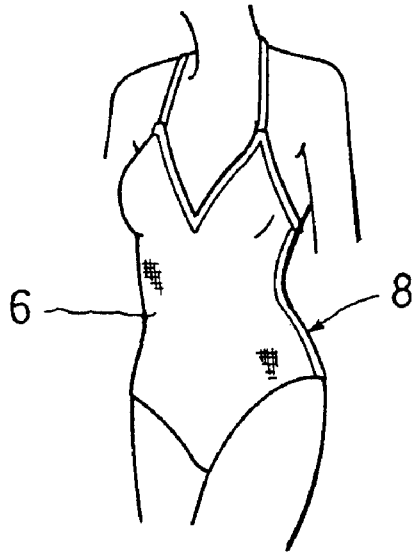
FIG. 7 is a view illustrating the first embodiment of the present invention used in a swimming suit.
Figure 8:
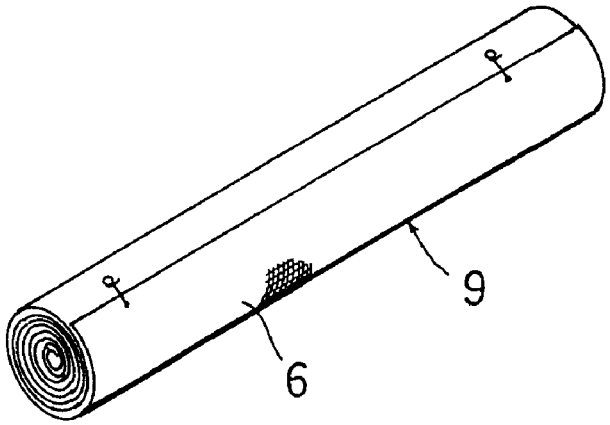
FIG. 8 is a view illustrating the first embodiment of the present invention used in a sheet processed to be a float.
Figure 9:
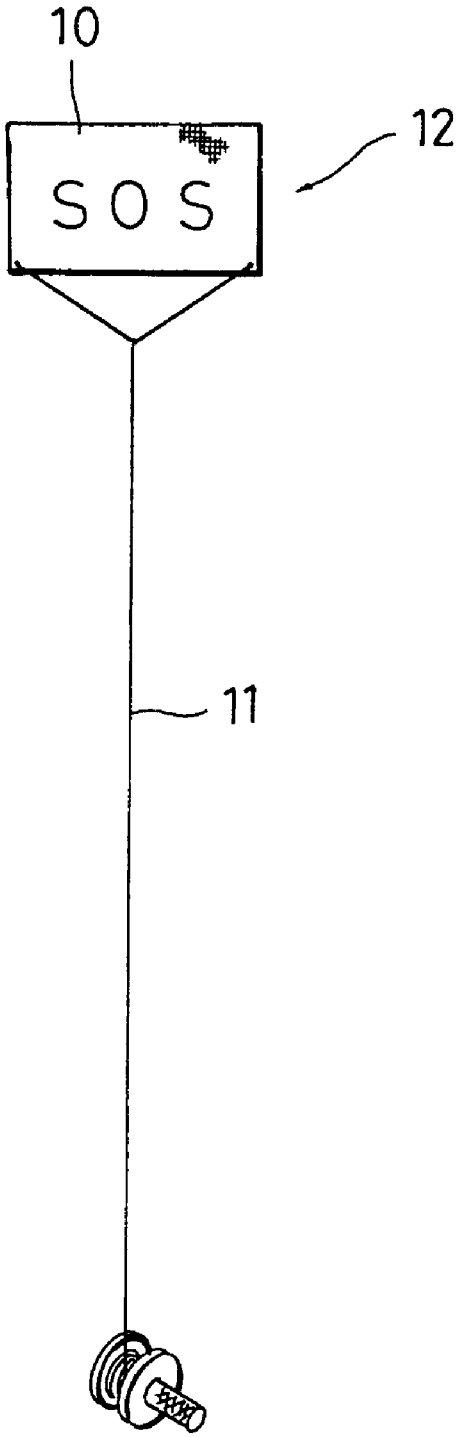
FIG. 9 is a view illustrating the first embodiment of the present invention used in a life flag.

The thread 1 is processible into a cloth 6 which may be used for survival equipment etc. as shown in FIG. 5. Additionally, the thread 1 may be used in stitching the life jacket 7 which is shown in FIG. 6. Furthermore, the thread 1 is usable in the construction of a swimming suit 8 which is shown in FIG. 7, and a sheet 9 may serve as a bladder when the cloth 6 is rolled as shown in FIG. 8. In addition, as shown in FIG. 9, the cloth 6 is useable as for a lifesaving flag 12 wherein a long thread 11, formed of the thread 1, is connected to a flag cloth 10 formed in the shape of a flag.

Other embodiments of the present invention will now be described referring to FIGS. 10 to 18. Through the drawings of the embodiments, like components are denoted by like numerals as of the first embodiment and will not be further explained in great detail.

Figure 10:
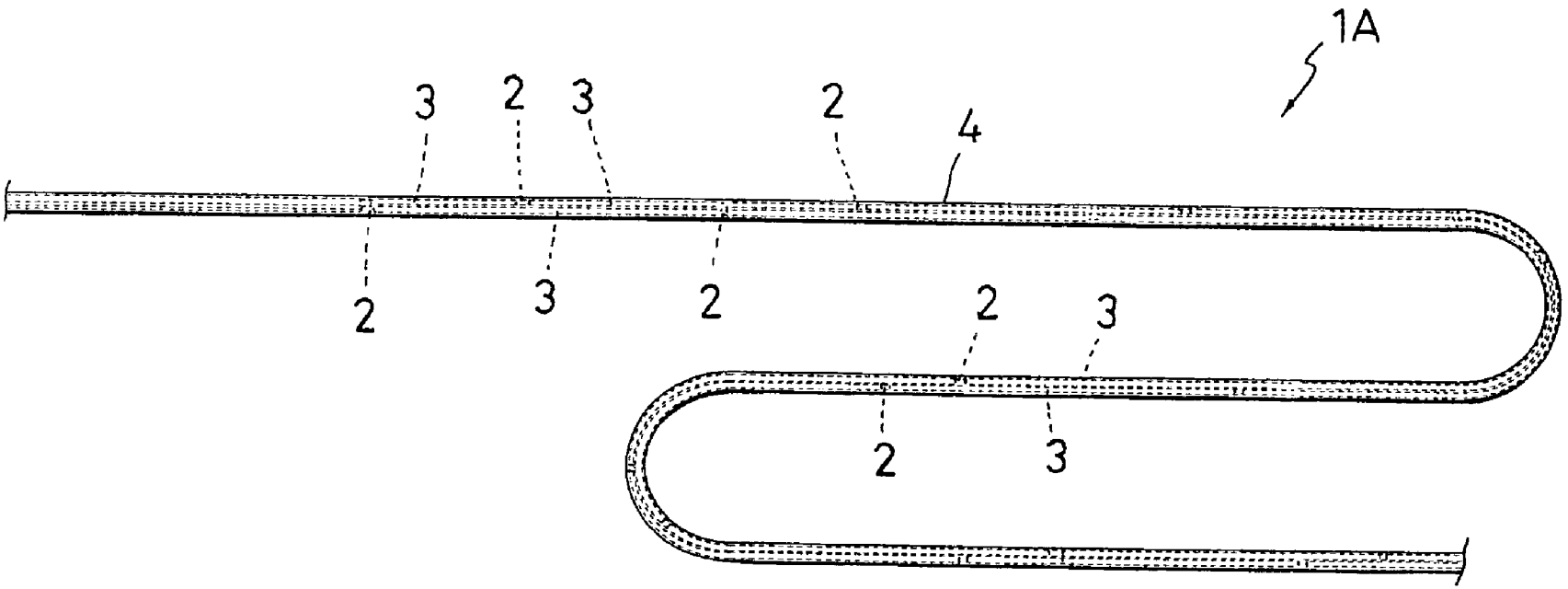
FIG. 10 is a side view showing a second embodiment of the present invention.
Figure 11:
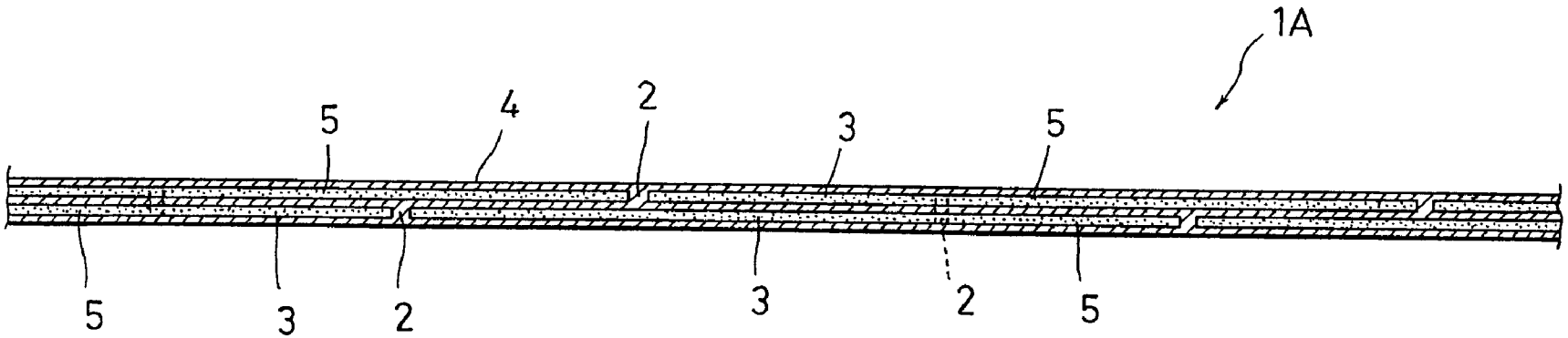
FIG. 11 is an enlarged vertical sectional view showing the second embodiment of the present invention.
Figure 12:
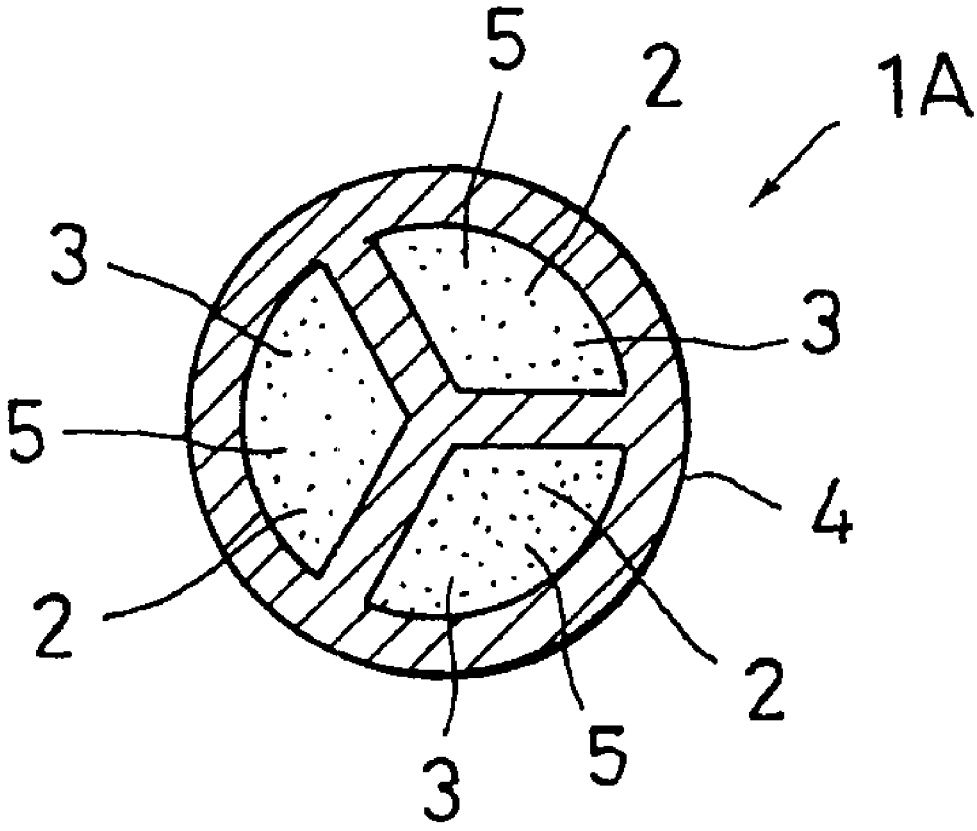
FIG. 12 is an enlarged horizontal sectional view showing the second embodiment of the present invention.

A second embodiment of the present invention is shown in FIGS. 10 to 12 and provides a thread 1A distinguished from the first embodiment in that the locations of the partitions 2 are offset from one another. Thus, while three radially adjacent chambers 3 are provided, the partitions 2 thereof are displaced from one another. The thread 1A according to the second embodiment has similar advantages to that according to the first embodiment. For instance, the effects of a crack are limited.

Figure 13:
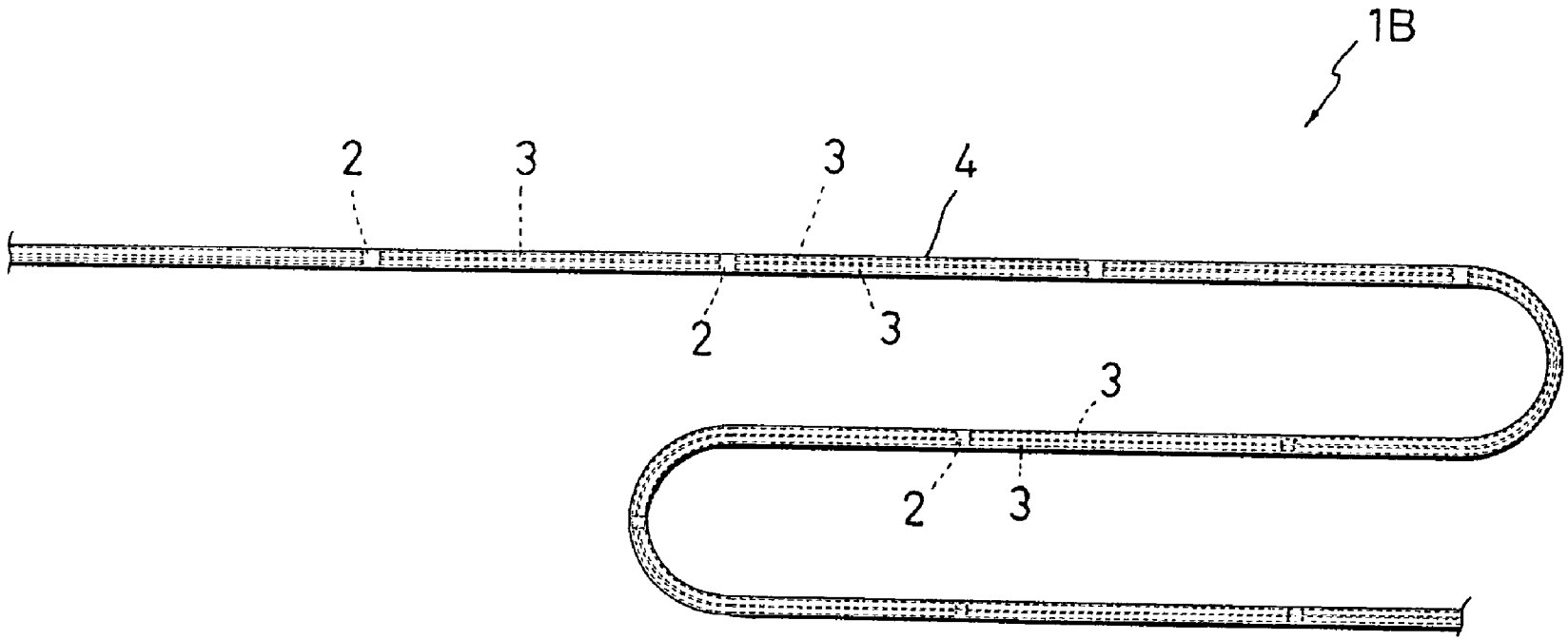
FIG. 13 is a side view showing a third embodiment of the present invention.
Figure 14:
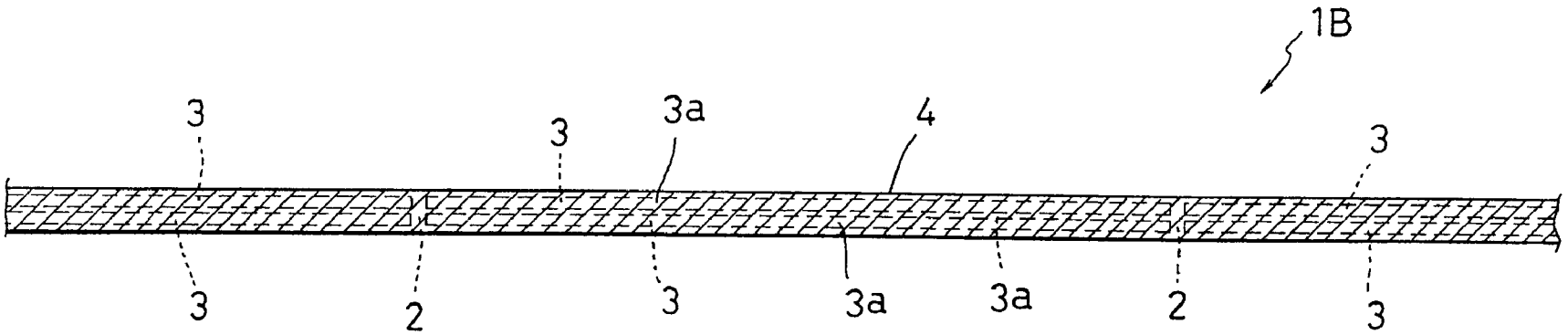
FIG. 14 is an enlarged vertical sectional view showing the third embodiment of the present invention.
Figure 15:
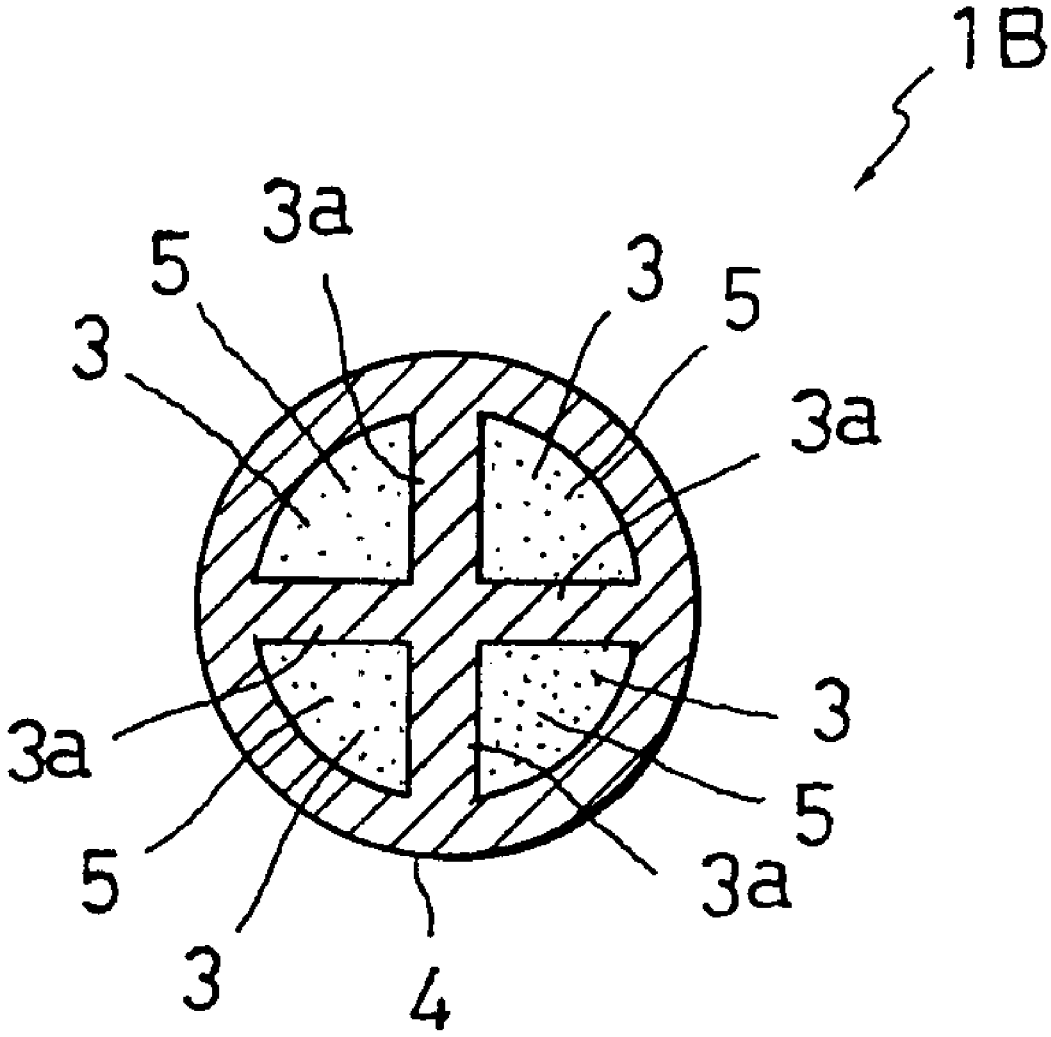
FIG. 15 is an enlarged horizontal sectional view showing the third embodiment of the present invention.

A third embodiment of the present invention is shown in FIGS. 13 to 15 and is distinguished from the first embodiment by the fact that four radially adjacent chambers 3 are formed in the thread body 4. A thread 1B in this way according to the third embodiment has similar advantages to that according to the first embodiment. Furthermore, a side wall 3*a* which is formed in the shape of a cross to define the four chambers 3 provides structural integrity to prevent the thread body 4 from being crushed.

Figure 16:
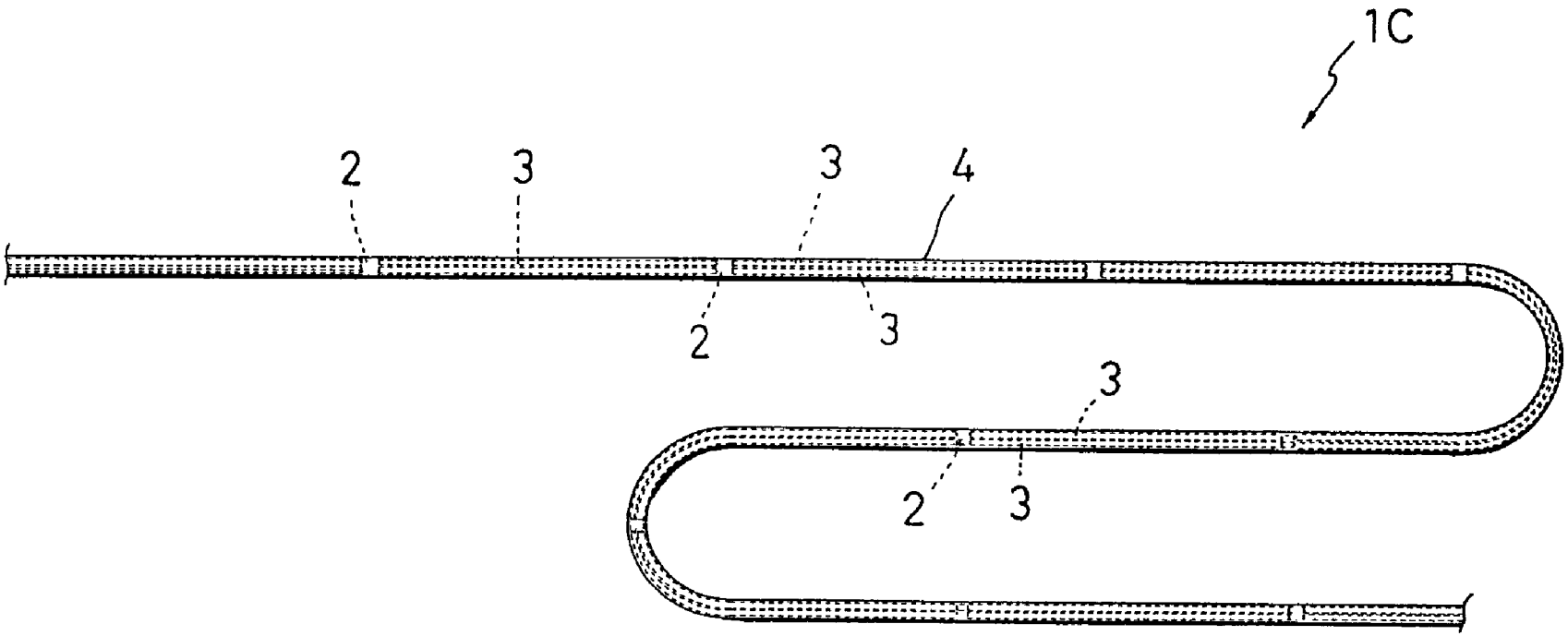
FIG. 16 is a side view showing a fourth embodiment of the present invention.
Figure 17:
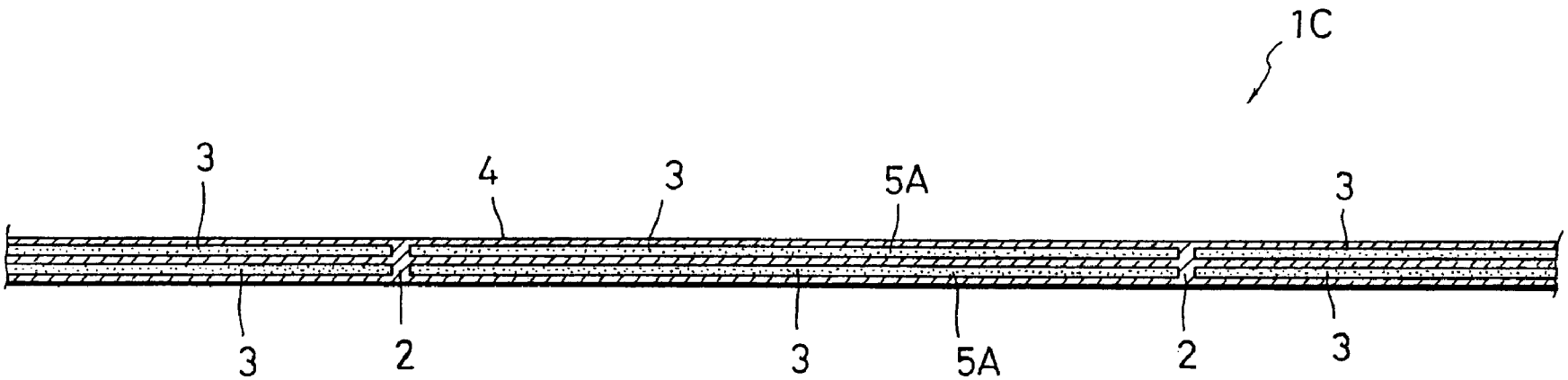
FIG. 17 is an enlarged vertical sectional view showing the fourth embodiment of the present invention.
Figure 18:
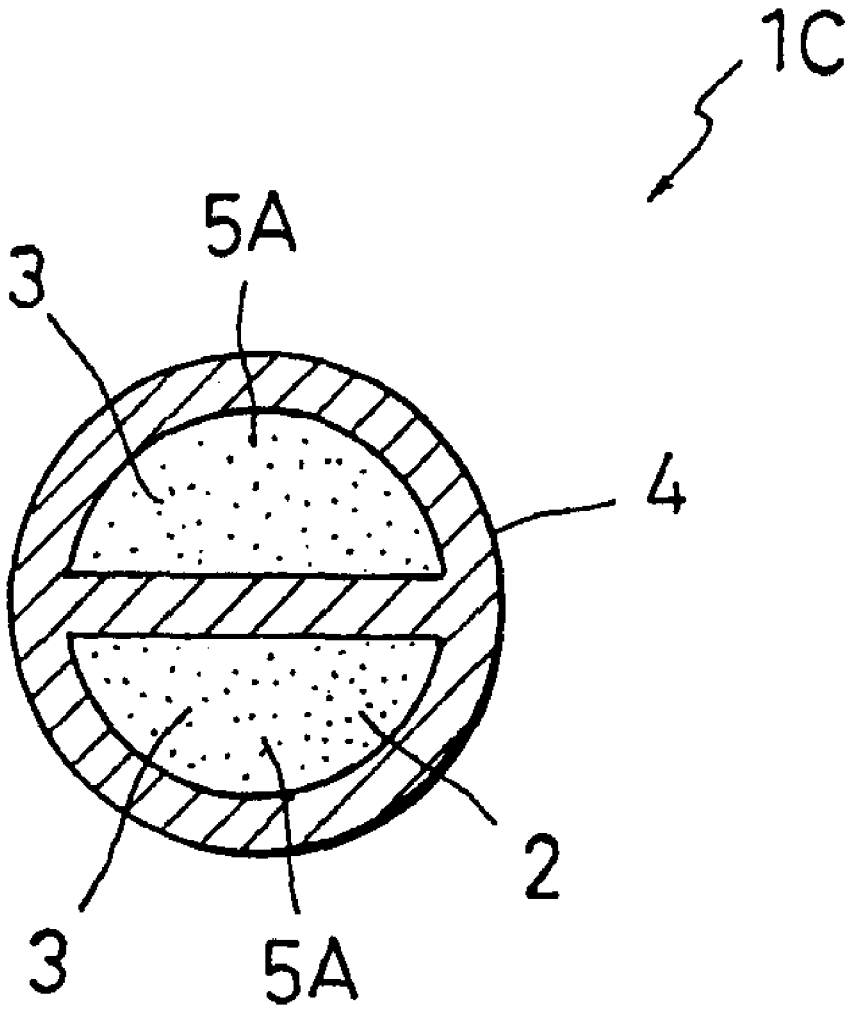
FIG. 18 is an enlarged horizontal sectional view showing the fourth embodiment of the present invention.

A fourth embodiment of the present invention is shown in FIGS. 16 to 18 and is distinguished from the third embodiment by the fact that two radially adjacent chambers 3 are formed in the thread body 4 and are filled up with gas 5A, which may include colored air or helium. Such colored gases may be used also in the other embodiments. A thread 1C according to the fourth embodiment has similar advantages to that according to the first embodiment, such as limiting the effects of a crack. Still further, when a crack occurs and the gas 5*a* escapes, the color of the thread 1C at the location of the crack will change. This facilitates inspection for damage.

In addition, although the above embodiments of the present invention have two, three and four radially adjacent chambers, the invention is understood to include embodiments having one chamber in a given cross section, that is, having single chambers linearly disposed in the thread, or having more than four radially adjacent chambers in a given cross section.

Figure 19:
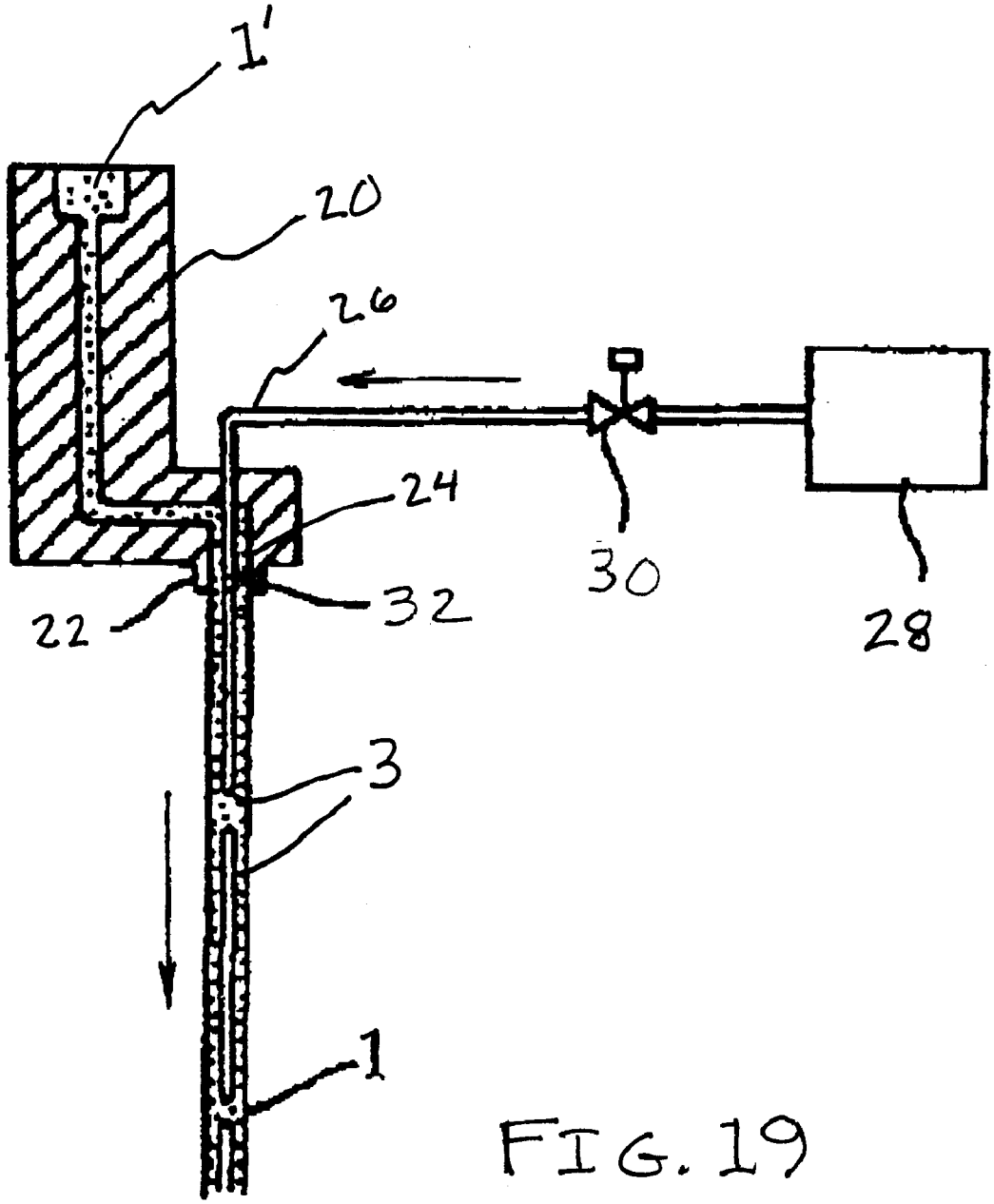
FIG. 19 shows a forming device for producing the thread of the present invention.

Referring to FIG. 19, a method of forming the thread 1 is illustrated. A forming device 20 channels liquid synthetic resin 1', which may either be molten or in solution, to an outlet 22, or spinneret, defining an outlet bore 24. A gas supply line 26 carries gas from a tank 28 and has a valve 30 therein for controlling the flow of gas. The gas supply line 26 carries the gas to a nozzle 32 disposed within the outlet 22. As the liquid synthetic resin 1' flows through the outlet 22 it surrounds the nozzle 32. The nozzle 32 injects gas into the liquid synthetic resin 1' to form the chambers 3 in the thread. Once the liquid synthetic resin 1' leaves the outlet 22, it stretches into a thinner stream and hardens either by cooling or evaporation of solvent. The individual chambers 3 are formed by operating the valve 30 to turn on and off the flow of gas from the tank 28. In the interest of simplicity, an arrangement is shown for making thread with singularly radially disposed chambers. However, the thread of the above embodiments having two or more radially adjacent chambers may be formed by increasing the number of nozzles and valves to individually control each nozzle.

As set forth above, the advantages of the invention are as follows:

(1) A thread comprises a thread body fabricated by synthetic resin material, having an almost uniform outside size, having chambers formed therein and separated by partitions at fixed intervals, and cross sections of the thread may be formed to defined at least one chamber at any given position excepting where a partition is located. The chambers are preferably filled with gas with a specific gravity lighter than air. Accordingly, the thread can be made to float on water or in air. Alternatively, the chambers may be filled with air itself in which case the thread will float on water.

Therefore, the thread can be used as a fishing line which floats on a sea surface or fresh water surface, or can be used as thread used for cloth used in a jacket, a swimming suit, a lifesaving flag, etc. Thereby, manufactures objects are lightweight and provide buoyancy without being bulky. Still further, the gas or air filled construction of the thread provides for higher thermal insulation, thus protection against the cold is also provided.

(2) As discussed above, since the chambers are separated by the partitions formed at predetermined intervals, when a crack reaches a chamber, the effect of the crack is limited to the one chamber and influx of water according to a capillary tube phenomenon is limited. Therefore, the thread can be used optimally as thread of cloth in survival equipment.

(3) When a crack forms in the thread body having at least two or more radially adjacent chambers, a local blowout state is avoided and buoyance in the area of the crack is maintained.

(4) Since at least two or more chambers are formed in the thread body and are filled with air or gas lighter than air, the thread is made light. Therefore, survival equipment which can be worn without a user feeling a sense of bulkiness can be manufactured using this thread.

What is claimed is:

1. A thread, comprising:

a thread body formed of a continuous and monolithic synthetic resin material and defining chambers serially disposed along a length of the thread body and separated from one another by partitions;

the chambers being radially adjacent chambers disposed along two to four radially adjacent longitudinal sectors of the thread body and separated by longitudinal side walls, and the partitions being serially disposed in said sectors; and gas filling the chambers of the thread body.

2. The thread, according to claim 1 wherein the gas is air.

3. The thread, according to claim 1 wherein the gas is lighter than air.

4. The thread, according to claim 1 wherein the gas is one of hydrogen and helium.

5. The thread, according to claim 1 wherein the gas is colored.

6. The thread, according to claim 1, wherein the partitions of the two to four sectors are disposed at common longitudinal locations along the length of the thread body.

7. The thread, according to claim 6 wherein the gas is air.

8. The thread, according to claim 6 wherein the gas is lighter than air.

9. The thread, according to claim 6 wherein the gas is one of hydrogen and helium.

10. The thread, according to claim 6 wherein the gas is colored.

11. The thread, according to claim 1, wherein the partitions are disposed at longitudinal locations longitudinal offset from one another.

12. The thread, according to claim 11 wherein the gas is air.

13. The thread, according to claim 11 wherein the gas is lighter than air.

14. The thread, according to claim 11 wherein the gas is one of hydrogen and helium.

15. The thread, according to claim 11 wherein the gas is colored.

* * * * *